US006568726B1

(12) United States Patent
Caspi et al.

(10) Patent No.: US 6,568,726 B1
(45) Date of Patent: May 27, 2003

(54) UNIVERSAL ELECTROMECHANICAL STRIKE LOCKING SYSTEM

(76) Inventors: Shlomo Caspi, 5903 Overlake Ave., San Diego, CA (US) 92120; Robert Hotto, 1005 Goldeneye View, Carlsbad, CA (US) 92009

( * ) Notice: Subject to any disclaimer, the term of this patent is extended or adjusted under 35 U.S.C. 154(b) by 126 days.

(21) Appl. No.: 09/702,111

(22) Filed: Oct. 30, 2000

(51) Int. Cl.[7] ..... E05B 15/02
(52) U.S. Cl. ..... 292/341.16; 292/144
(58) Field of Search ..... 292/341.16, 144, 292/341.15

(56) References Cited

U.S. PATENT DOCUMENTS

| | | | | | |
|---|---|---|---|---|---|
| 1,805,451 | A | * | 5/1931 | Keil | 292/341.16 |
| 2,916,319 | A | * | 12/1959 | Bois | 292/341.16 |
| 3,910,617 | A | | 10/1975 | Scalza et al. | |
| 4,017,107 | A | | 4/1977 | Hanchett | |
| 4,099,752 | A | | 7/1978 | Geringer | |
| 4,125,008 | A | | 11/1978 | Genest et al. | |
| 4,211,443 | A | | 7/1980 | Butts et al. | |
| 4,595,220 | A | * | 6/1986 | Hanchett | 292/341.17 |
| 4,656,850 | A | | 4/1987 | Tabata | |
| 4,929,003 | A | * | 5/1990 | Mcconnell | 292/144 |
| 5,076,625 | A | | 12/1991 | Oxley | |
| 5,100,184 | A | | 3/1992 | Schmitt | |
| 5,100,186 | A | * | 3/1992 | Nordvall | 292/341.16 |
| 5,118,150 | A | | 6/1992 | Jarrett | |
| 5,484,180 | A | | 1/1996 | Helmar | |
| 5,490,699 | A | | 2/1996 | Uyeda | |
| 5,540,069 | A | | 7/1996 | Muller et al. | |
| 5,735,559 | A | | 4/1998 | Frolov | |
| 5,850,753 | A | * | 12/1998 | Varma | 70/278 |
| 6,022,056 | A | * | 2/2000 | Cope | 292/144 |

* cited by examiner

*Primary Examiner*—Gary Estremsky
(74) *Attorney, Agent, or Firm*—Morrision & Foerster LLP

(57) ABSTRACT

A universal electromechanical strike locking system for doors comprising linear horizontal moving strikes in the doorjamb for locking and releasing both dead bolts and latch bolts. The system operates in doors having one or more dead bolts and/or one or more latch bolts. The system allows locking and releasing doors by either operating the conventional locking system of the door or the universal electromechanical strike locking system. The system comprises a controller with user access means that coordinates one or a plurality of electromechanical strikes in a fault tolerant method employing closed loop control.

25 Claims, 10 Drawing Sheets

UNIVERSAL ELECTROMECHANICAL STRIKE LOCKING SYSTEM

BACKGROUND OF THE INVENTION

The present invention relates to electric door locking and releasing systems, which comprise electromechanical strikes installed in the doorjamb, providing adaptable comprehensive door locking and releasing functions. It is applicable for use with most door locks and to a wide variety of combinations of dead bolts and latch bolts.

Most main entry doors consist of two types of bolts, a dead bolt and a latch bolt. These two types of bolts provide different and necessary functions that together enable the normal operation of a modem main entry door. The latch bolt latches and holds the door in a closed position. It enables the user to push or swing the door closed and latched, and positions it for the dead bolt operation. The dead bolt, when locked, provides a secure and tamper resistant locking function. The functions of these bolts are accomplished as follows:

Dead bolts usually have two detent positions, the locked position in which the dead bolt is extended out of the mortise in the door, and the unlocked position in which the dead bolt is retracted into the mortise.

There are two main kinds of latch bolts, the simple latch bolt and the complex latch bolt (the complex latch bolt is also known in the art as the dead latch bolt.) Latch bolts usually extend out of the door by a spring in the mortise. The simple latch bolt is an angular tongue-like bolt that operates against a spring in the mortise. The complex latch bolt is a similar angular tongue-like bolt that operates against a spring but also comprises a disabler element, collateral to the tongue-like bolt that operates against a second spring in the mortise. When the disabler element of the complex latch bolt is pushed into the mortise while the latch bolt is extended out of the mortise, the latch bolt is locked in its extended position and cannot be pushed into the mortise. This provides secure and tamper resistant functionality to the complex latch bolt, overcoming a shortcoming of the simple latch bolt. This feature of the complex latch bolt prevents a potential intruder from opening the latch bolt by sliding a thin card such as a credit card between the door end and the doorjamb.

The present invention, in contrast to prior art, operates with all conventional dead bolts and latch bolts, in any combination. The present invention enables operation with the two types of latch bolts, the simple latch bolt and the complex latch bolt, employing the same mechanism. The present invention can also operate the latch bolt independently, whether or not the dead bolt is extended out of the mortise.

Providing integrated solutions to all types of bolts is necessary for a comprehensive adaptable electromechanical strike locking system to be useful. Prior art adaptable electromechanical strike locking systems do not control the releasing and locking of strikes for both latch bolts and dead bolts in a single system since different strikes would be necessary for each type of bolt and different controllers would be necessary for each type of strike. It is cumbersome for a user to operate more than one controller to open an electromechanical strike locking systems. The present invention simplifies the control of the electromechanical strike locking system by providing a universal strike for both the dead bolt and the latch bolt and a single controller. Prior art electromechanical strike locking systems have not addressed integrated fault tolerant mechanisms. A fault tolerant system, operating both the dead bolt and the latch bolt, is necessary for locking systems to operate reliably and provide confidence to the user of reliability. These deficiencies in the prior art may have hindered the wide acceptance of this technology, as users require dependable operation under any conditions. There is a need for a complete integrated system that addresses the need for better functionality and flexibility of electromechanical strikes and the compatibility with a wide variety of door lock configurations as addressed by the present invention.

PRIOR ART

Prior art electromechanical strike locking systems have not gained widespread acceptance and use because of deficiencies in reliability, the lack of fault tolerance capability, and the inability to operate them with an assortment of preinstalled locks in various configurations. Prior art electromechanical strike locking systems are difficult to install and operate because they lack the universality of the present invention, i.e., one type of strike for both the latch bolts and the dead bolts, and the ability to employ the same strike for left and right doorjambs.

These deficiencies in prior art electromechanical strike locking systems are not an issue in exclusive electromechanical strike locking systems, which have gained wide acceptance in business and industrial applications. An exclusive electromechanical strike locking system is a self-contained locking system, i.e., the mortise in the door and the electromechanical strike are installed together as one operable unit, which does not allow for interoperability with other existing locking systems. An example of one exclusive electromechanical strike locking system is the SDC series 50 manufactured by Security Door Controls of Westlake Calif. The system does not allow for interoperability with other locking systems and, therefore, is an exclusive electromechanical strike locking system. The present invention, in contrast, is an adaptable and comprehensive electromechanical strike locking system that works with a variety of existing locks by requiring only the retrofitting of the strikes in the doorjamb.

U.S. Pat. No. 4,017,107 by Hanchett, dated Apr. 12, 1977 (hereinafter Hanchett 107) provides a strike frame for receiving a dead bolt or a latch bolt and to allow the bolts to move through a notch in the doorjamb. Hanchett 107 teaches the use of a rotary pivoting shutter as a lock system. The system operates by means of a vertical rotary motion that opens and closes the strike.

The present invention solves the deficiency encountered by the vertical rotary operation, in particular the operation with the latch bolts. The design of a latch bolt requires that it be pushed transversely upon a lipped plate to lock and latch the door. The contouring of the latch bolt tongue makes the vertical rotary motion of that type of strike unworkable. Also, the rotary motion of the shutter defeats the operation of the disabler of the complex latch bolt.

The improvements of the present invention for the locking and releasing of bolts are achieved by the use of linear horizontal movement of the strike. The linear horizontal motion of the strike enables controlling the motion contour of the strike in both directions, the distance of the motion and the calibration of the travel distance.

The present invention enables the use of locking mechanisms that can work with most sizes and combinations of dead bolts and latch bolts (both simple and complex latch bolts), and provides a complete and integrated system.

U.S. Pat. 5,100,186 by Nordvall, dated Mar. 31, 1992 (hereinafter Nordvall 186) teaches the employment of a linear vertical motion of a slide within a strike in the doorframe. The vertical motion of the slide presents limitations for the operation of the latch bolt, in particular for the transverse movement of the latch bolts tongue against the strike. In addition the fixed size of the recess in the strike is not adjustable to receive different sizes of dead bolts, and the strike is not reversible, thus, requires the use of left-right systems. The system in Nordvall 186 also does not provide a fault tolerant method employing closed loop control. In contrast, the present invention is universal to all left-right, inside-outside doors. It permits the control of the speed of the strike, the user can calibrate the travel distance of the strike, and it enables the use of a fault tolerant operation employing closed loop control. Further, the present invention, due to its horizontal motion, also operates with all types of latch bolts, thus, lending itself to a comprehensive lock system.

The present invention enables, for the first time, an adaptable and comprehensive electromechanical strike locking system, operating on both the dead bolt and the latch bolt, which allows the user to independently operate the door either by using the conventional door access system or the electromechanical strike locking system.

BRIEF DESCRIPTION OF THE DRAWINGS

FIGS. 1, 2, & 3 depict the dead bolt keeper of the present invention with one conceivable embodiment of an electro-kinetic transducer consisting of a rotary actuator and a rotating-to-linear motion translator in three positions. In FIG. 1 the strike is pushed out and the door is closed and locked. In FIG. 2 the strike is pulled in and the door is closed but not locked; and in FIG. 3 the strike is pulled in and the door is open.

FIG. 4 depicts the dead bolt strike of the present invention employing a linear motion translator. The strike is pulled in and the door is unlocked and opened. The linear translator illustrated comprises a motor connected to a stationary screw by means of a worm gear, which moves the strike from the pulled-in position to the pushed-out position. Also illustrated is a solenoid at a right angle to the movement of the strike, which provides additional tamper security when engaged.

FIG. 5 depicts the dead bolt keeper of the present invention employing a linear motion translator comprising a non-captive screw and a motor.

FIG. 6 depicts a combined dead bolt and latch bolt keeper of the present invention with one electro-kinetic transducer consisting of a rotary actuator and a rotating-to-linear motion translator.

FIGS. 7 & 8 depict the latch bolt keeper of the present invention with one embodiment of an electro-kinetic transducer consisting of a rotary actuator and a rotating-to-linear motion translator in two positions. In FIG. 7 the strike is pulled in and the door is open and in FIG. 8 the strike is pushed out, the disabler is pushed into the mortise and the door is locked.

FIG. 9 depicts the specific case of the dead latch bolt operation in two positions. Illustrated in broken lines the door is open and the disabler is pushed out of the mortise, and in the uninterrupted lines, the latch bolt is in the strike and the disabler is pushed into the mortise.

FIG. 10 depicts a front view of the latch bolt keeper attached to the doorjamb.

FIG. 11 shows, in a schematic block diagram, the electrical components of the present invention, assuming two strikes, one for the dead bolt and one for the latch bolt.

FIG. 12 shows the sequential steps in the operation of the invention with a door having both a dead bolt and a latch bolt.

FIG. 13 shows the sequential steps in the operation of the invention with a door having either a dead bolt or a latch bolt.

DETAILED DESCRIPTION OF THE INVENTION

Figure 1:
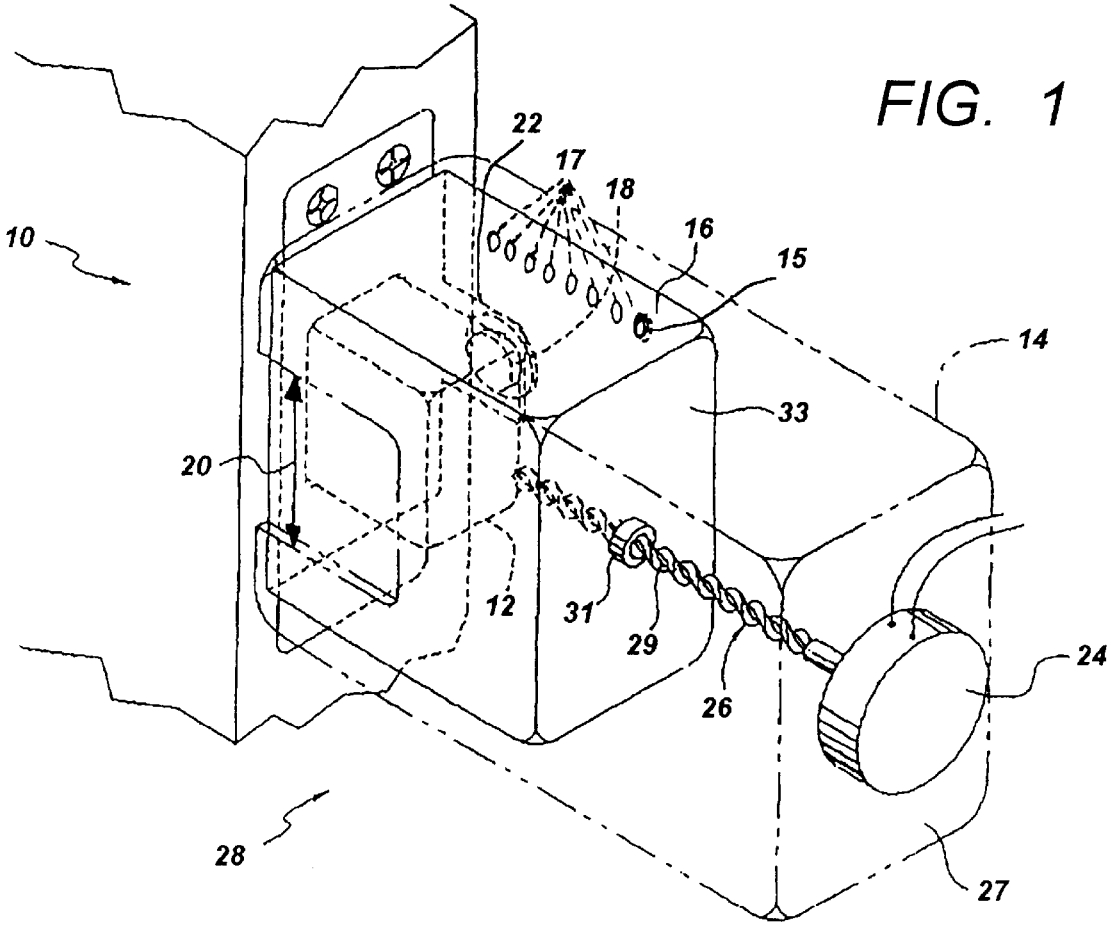
FIG. 1 is a front, top left, perspective view of the dead bolt keeper of the present invention with the strike in the pushed-out position.
Figure 2:
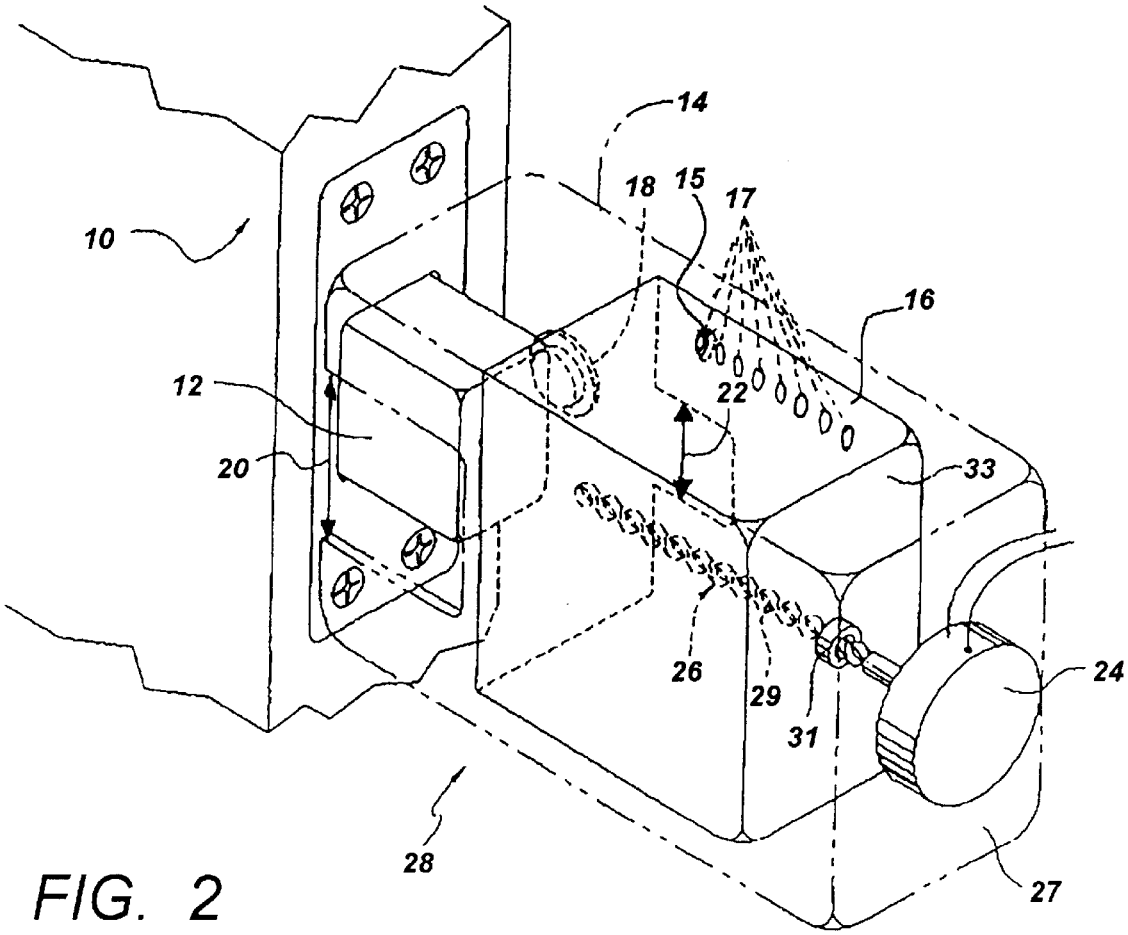
FIG. 2 is a front, top left, perspective view of the dead bolt keeper with the strike in the pulled-in position.
Figure 3:
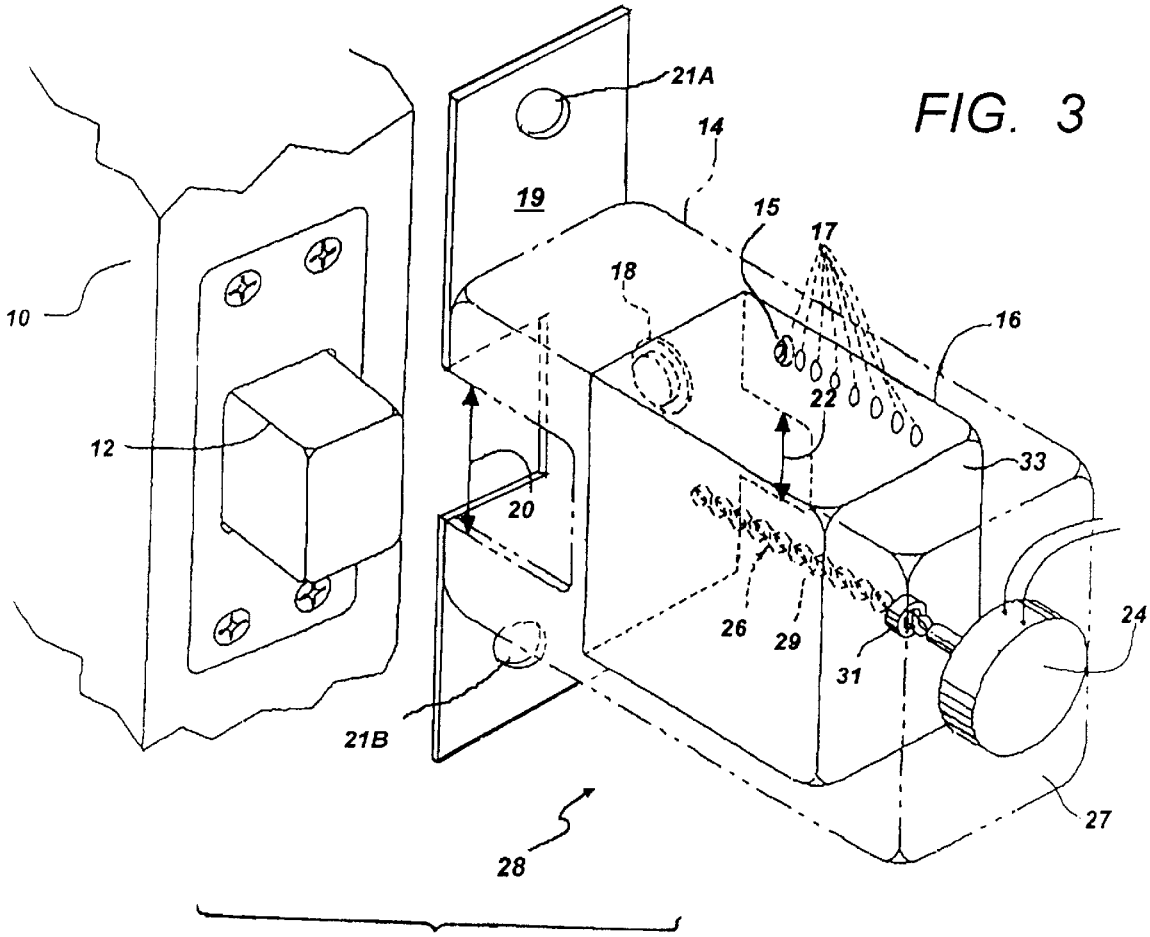
FIG. 3 is a front, top left, perspective view of the dead bolt keeper with the strike in the pulled-in position with the door open.

Illustrated in FIG. 1, FIG. 2 and FIG. 3, is door 10 having dead bolt 12, dead bolt keeper 28 comprising receiver 14 with: 1) Dead bolt strike 16 in its pushed-out position where door 10 is closed and locked (FIG. 1); 2) Strike 16 in its pulled-in position where door 10 is closed but unlocked (FIG. 2); and 3) Strike 16 in its pulled-in position where door 10 is opened (FIG. 3). Dead bolt keeper 28, which is located in the doorjamb, comprises receiver 14, strike 16, strike position sensor 15, position detectors 17 comprising holes, dead bolt strike actuator 24, and motion translator unit 26. Dead bolt keeper 28 is attached to dead bolt plate 19 (FIG. 3 only), which is screwed to the doorjamb through dead bolt plate holes 21 (A & B). Dead bolt plate 19 is shown in FIG. 3 only for simplification. The doorjamb cavity has an opening parallel to receiver opening 20 to allow the door's dead bolt 12 to pass through it. Strike 16, which is connected to dead bolt strike actuator 24 by motion translator 26, moves backward to its pulled-in position in receiver 14 when it is in the unlocked mode and forward to its pushed-out position in receiver 14 when it is in the locked mode.

Strike 16 has an opening 22 for sensor 18, which is located on the inner side of receiver 14 on the opposite side to receiver opening 20. When sensor 18 senses dead bolt 12 in receiver 14, it signals micro-controller 130 (FIG. 11), which moves strike 16 to its pushed-out position. When strike 16 is pulled in to its unlocked position, dead bolt 12 of door 10 is free to swing out of receiver 14 through receiver opening 20, thus door 10 is unlocked. When strike 16 is pushed out in its locked position, dead bolt 12 cannot swing out of receiver 14 and door 10 is locked.

Responsive to micro-controller 130 (FIG. 11), dead bolt actuator 24 (here a DC motor), which is mounted on the back side 27 of receiver 14, pulls in strike 16 via motion translator unit 26, allowing dead bolt 12 to swing out of receiver 14. As shown in FIGS. 1, 2, & 3, motion translator 26 is a fixed screw 29, turning through a nut 31, which is fixed in the back 33 of strike 16. When screw 29 is turning, nut 31 moves upon it, carrying strike 16 to the pre-selected position. Dead bolt strike actuator 24 is held stiffly in its final positions by means of micro-controller 130 applying dynamic braking to motor 24 after it has stopped and positioned.

Figure 4:
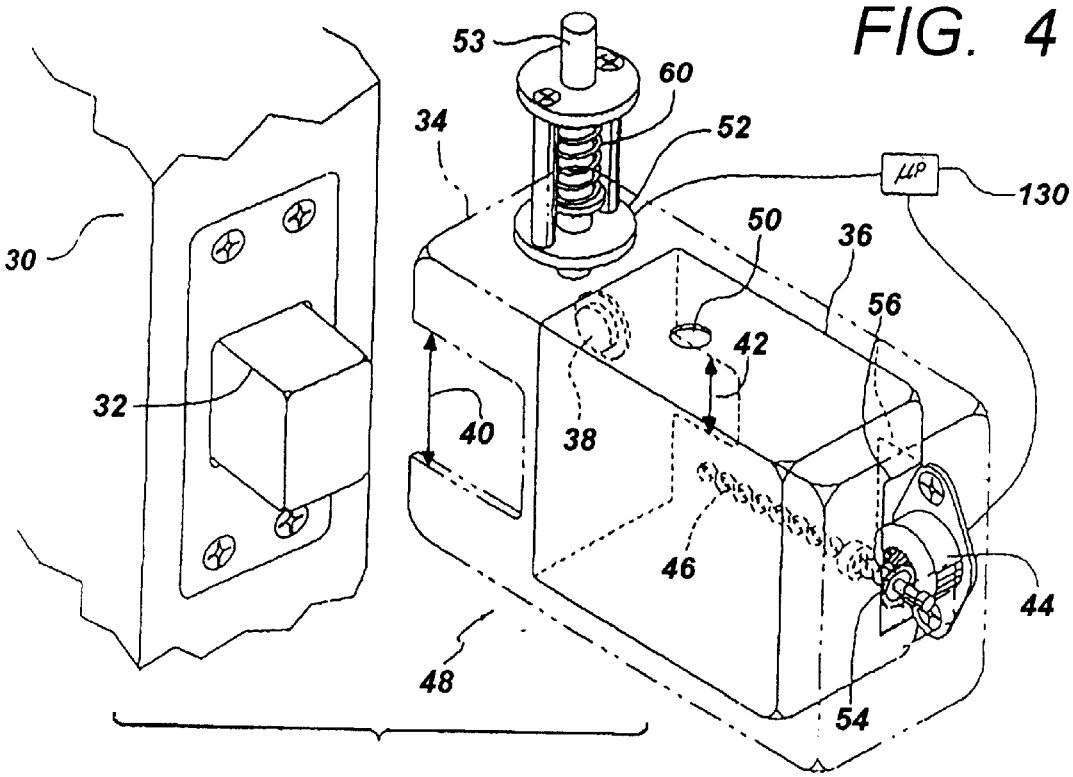
FIG. 4 is a front, top left, perspective view of another embodiment.

Dead bolts usually have two detent positions, the unlocked position in which the dead bolt is retracted into the mortise in the door, and the locked position, in which the dead bolt is extended out of the mortise. Some main doors open to the outside in which case the doorjamb opening is facing the outside. To prevent an intruder from forcing strike 16 from its pushed-out position in doors that open to the outside, both mechanical and electrical resistance are employed when the strike is in its pushed-out, locked position. The mechanical means may comprise employment of a system, such as a worm gear 54 (see FIG. 4 & FIG. 6) or other mechanical gearing, coupled with a screw and nut that provides resistance to motion at the side coupled to the strike and use of a locking solenoid 52 at an angle to the movement (FIG. 4). The electrical resistance means comprises employment of dynamic braking on a DC motor, which does not expend power on the system. This is accomplished by connecting or shorting together the coil leads of the motor using a switch, such as a relay or transistor, located in front of the drive circuitry. Dynamic braking provides a resistive force to any motion, such as may be caused by tampering, due to the effect that the motor in dynamic braking acts as a generator, powering a large load. When the motor is driven by the system, the relay or switch is first opened, removing the dynamic braking.

Strike 16 is in its pushed-out position when sensor 18 is activated by dead bolt 12, i.e. when door 10 is closed and dead bolt 12 is extended out of the mortise in the door. When door 10 is being opened using the conventional system by retrieving the dead bolt 12 into the mortise in the door, sensor 18 signals to micro-controller 130 that dead bolt 12 is not extended out of door 10 and strike 16 is pulled to its pulled-in position. Even though the user could close door 10 at that point with strike 16 in its pushed-out position, the strike 16, nevertheless, is pulled to its pulled-in position. This enables the complementary system to receive an extended dead bolt 12 if for some reason the user moves the dead bolt 12 from its retracted to its extended position after the door is opened. When door 10 is being closed while dead bolt 12 is extended out of the mortise in the door, dead bolt 12 activates sensor 18, which produces an electric signal to the system indicating that the door is closed and the dead bolt 12 is extended out and in place in receiver 14. Dead bolt 12 may activate sensor 18 also, by closing door 10 with dead bolt 12 being retracted into the mortise in the door and by manually turning the dead bolt 12 to its locked position after door 10 has been closed. When door 10 is closed, dead bolt 12 is extended out, and strike 16 is in its pushed-out position, system indicator 144 signals to the user that door 10 is locked.

The system's closed loop control comprises micro-controller 130, its closed loop software interfaced to strike position sensor 15 and position detectors, holes 17. The closed loop control mechanism enables fault tolerance for the lock system of the present invention in instances of mechanical problems such as damaged components or temporary obstructions. The closed loop control provides additional user safety in case the user physically obstructs the system.

By means of the setup software in the system, employing the closed loop control and initialization, the user can calibrate and store parameters, such as the initial and final positions of the strikes. The calibration is useful since bolts in doors come in many different sizes and configurations. The calibration control provides a means for enabling the user to obtain an optimized installation of the system. The calibration control enables the user to set up the limit positions of the dead bolt strike 16 at both ends of its movement and store these values in the system memory. This is important so that strike 16 does not push against dead bolt plate 19 when strike 16 is in its pushed-out position (FIG. 1) and would not be pulled into a position beyond the end of the dead bolt when strike 16 is in its pulled-in position (FIG. 2). This calibration feature optimizes movement and thereby saves energy, important for battery powered systems, and decreases wear caused by strike 16 slamming into the doorjamb.

In one embodiment, the closed loop control consists of micro-controller 130 interfaced to strike position sensor 15, such as a snap switch manufactured by Snaptron Inc. of Loveland, Colo., located on the inner wall of receiver 14 (FIG. 1), which is focused to read position detectors 17, illustrated in FIGS. 1, 2, & 3 as holes in strike 16, parallel to strike position sensor 15. When strike 16 pushes against snap switch 15, switch 15 closes a circuit, which is interpreted by micro-controller 130 as 'circuit close'. When one of the position detectors holes 17 covers snap switch 15, switch 15 snaps out and opens the circuit, which is interpreted by micro-controller 130 as 'circuit open'. In another embodiment, the closed loop control mechanism subsystem could also consist of strike position sensor 15 in the form of a reflective photo-sensor, such as the Reflected Photo-Sensor manufactured by Omron Electronics of Japan, mounted on the inner wall of receiver 14, and the position detectors 17 would be reflective encoding marks printed on the outer side of strike 16 facing reflective photo-sensor 15.

The following description of the closed loop control operations assumes a reflective photo-sensor and reflective encoding marks. When the system is powered on for the first time, the indexing operation is initiated to move the strike 16 to the pushed-out position, which is the "home" position. This operation is controlled by micro-controller 130 actuating the motor of actuator 24 in a first direction, for example, clockwise, and then if necessary the opposite direction, at a constant speed while reading back reflective encoding marks from the reflective photo-sensor. As strike 16 is moved, the encoding is read and referenced to an internal timer in micro-controller 130. The "home" position, for example the pushed-out position of strike 16, is detected by means of reading the end position encoding, for example 2 marks that are closely spaced. The "far" position, for example the pulled-in position of strike 16, is detected by means of reading the "far" position encoding, for example 2 marks that are widely spaced. There are a set number of detectable marks between the two ends, for example, 10 marks. By doing so, microprocessor 130 is being taught the two maximum traveling positions of strike 16 within receiver 14.

To set up the system, the operator, through a keystroke sequence, enters into the set-up mode on the keypad display subsystem, which provides a user menu selection. The keypad display subsystem is part of the inside audiovisual (a/v) system 148 (FIG. 11), which provides a user menu selection. Once in this mode, the operator presses the "home" command. This causes the motor of dead bolt actuator 132 (FIG. 11) to turn clockwise or counterclockwise and move strike 16 to its pushed-out position. The motor of actuator 132 increments the strike 16 position until the micro-controller reads the end position encoding (2 closely spaced marks) and marks the position in its memory as the "home" position. Micro-controller 130 then moves strike 16 back and the operator presses the stop button when dead bolt 12, while extended out of the door, can move out of keeper 28. This is now marked by micro-controller 130 as the desired "far" or pulled-in position of strike 16, which may differ from the "far" position indicated by the 2 marks spaced far apart. This is the maximum distance that is set for strike 16 to move to the pulled-in position. This will save power by moving strike 16 the minimum distance required and also serves as a safety device to prevent a space between the dead bolt and the strike (when the dead bolt is extended out and the strike is in the new pulled-in position) preventing an object or finger from being placed between the dead bolt and the strike.

Thus, the linear horizontal moving strike of this electromechanical strike locking system is adaptable for use in any door with any size dead bolt, because it can be calibrated to fit any such door and dead bolt.

The "home" position can be either the pushed-out position of strike 16 or the pulled-in position of strike 16. The calibration mode enables an operator to incrementally advance the strike 16 between the pushed-out position and the pulled-in position in the keeper 28 assembly and set and store the positions.

FIG. 4 shows door 30 with dead bolt 32, dead bolt keeper 48 comprising receiver 34 and strike 36 in its pulled-in position. There is dead bolt sensor 38, receiver opening 40, and strike opening 42 similar to sensor 18, receiver opening 20 and strike opening 22 of FIGS. 1, 2, & 3. The transducer in this embodiment, which consists of actuator 44, worm gear 54, and screw 46, is mounted on the inner side of receiver 34 on the same side as sensor 38. Actuator 44 is a stepper motor, such as the series 20,000 by HIS of Waterbury, CT. Worm gear 54, and screw 46 transfer the rotating motion of actuator 44 to linear motion. Also shown in FIG. 4 is strike opening 56, associated with actuator 44 and worm gear 54, to allow strike 36 to move all the way back in receiver 34.

FIG. 4 also shows a method to secure strike 36 in its pushed-out or closed position to prevent forced opening of the strike when door 30 is opened to the outside. Illustrated in the drawing is solenoid 52. Solenoid 52 is a bi-stable solenoid, such as model SCL0929 by Bicron Electronics of Canaan, CT, which has two stable positions, an open position, whereby pin 53 of solenoid 52 is held by the magnetic field of solenoid 52 and a closed position, whereby the pin 53 of solenoid 52 is held by spring 60. While any electromechanical controlled latching and bolting methods could be employed to accomplish the function of solenoid 52, a bi-stable solenoid is a preferable method when the system is powered by batteries. When strike 36 is in its pushed-out position, bi-stable solenoid 52 receives a signal from micro-controller 130 and pin 53 moves to its closed position, inserting pin 53 into strike hole 50. Solenoid 52 could be positioned on other locations on the receiver 34 or it could be positioned on the strike 36, whereupon hole 50 would be located on receiver 34.

To open door 30, micro-controller 130 sends a signal to drive solenoid 52 and pin 53 is pulled in to its open position. Thereafter, micro-controller 130 sends a signal to actuator 44 and strike 36 is pulled in.

Figure 5:
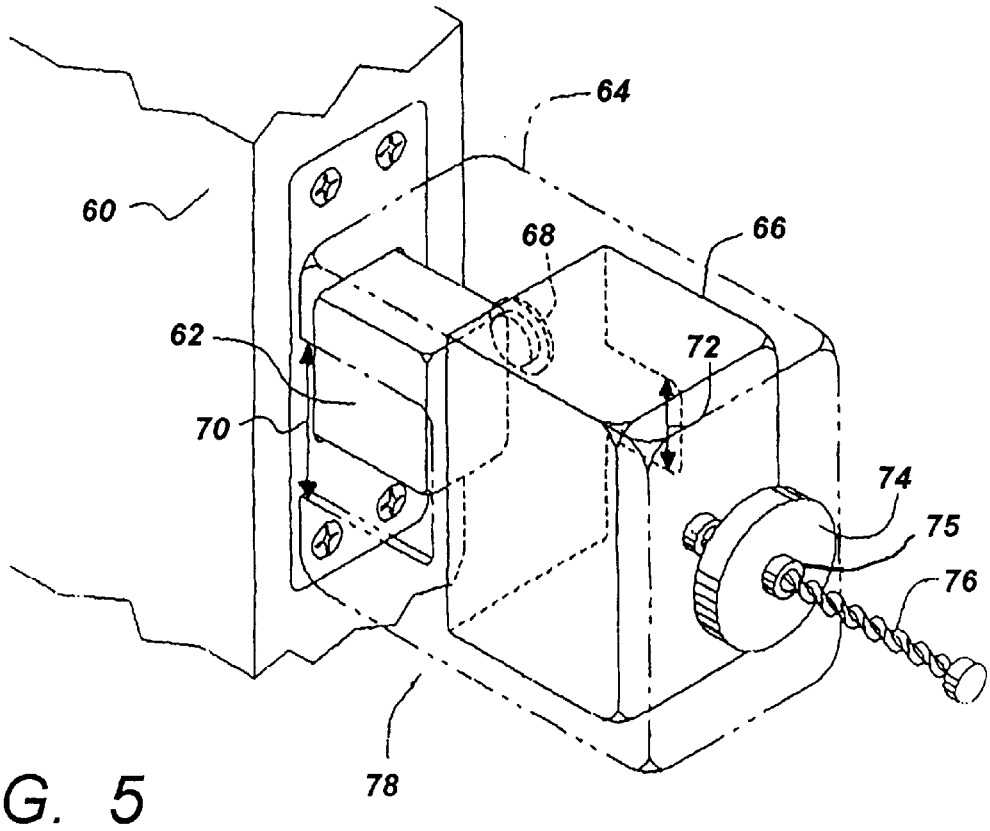
FIG. 5 is a front, top left, perspective view of another embodiment.

FIG. 5 shows another embodiment of the invention whereby the transducer consists of non-captive actuator 74 and motion translator 76 such as HIS's non-captive micro-stepper. There is door 60, and dead bolt 62. Also illustrated is dead bolt keeper 78 comprising receiver 64, strike 66, sensor 68, receiver opening 70, and strike opening 72 corresponding in their functions to receiver 14, strike 16, sensor 18, receiver opening 20, and strike opening 22 in FIGS. 1, 2, & 3.

Figure 6:
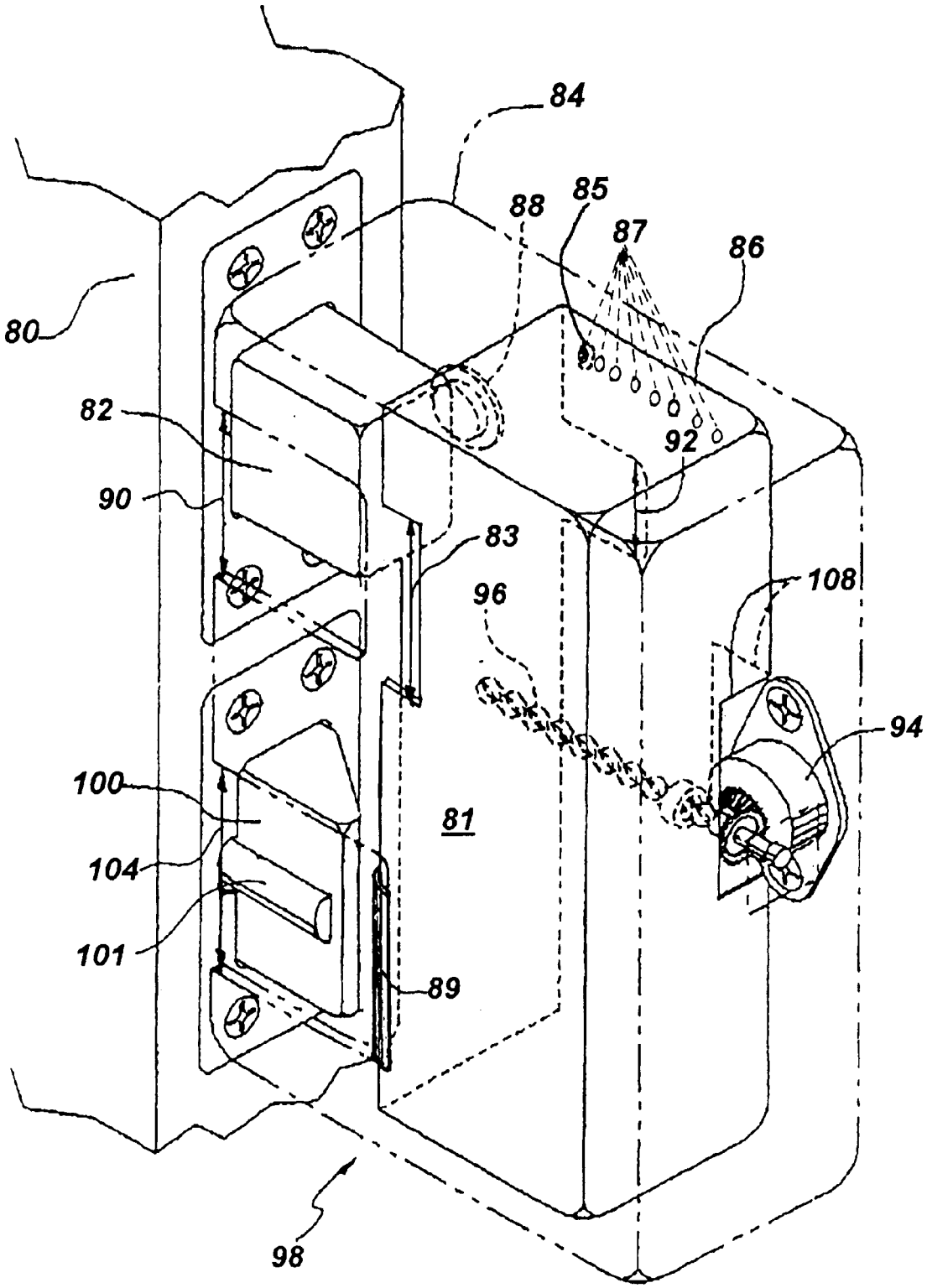
FIG. 6 is a front, top left, perspective view of a combined dead bolt-latch bolt embodiment.

Motion translator 76, which is a non-captive screw, slides through nut 75 and is attached to strike 66. When motor 74 is rotating, motion translator 76 slides through nut 75, converting the rotational motion to linear motion. Motion translator 76 moves strike 66 between its pushed-out position and its pulled-in position depending upon the direction of actuator's 74 rotation, FIG. 6 is another embodiment of the invention whereby receiver 84 and strike 86 cover both dead bolt 82 and latch bolt 100 employing a stepped plate 81. In FIG. 6 there is shown dead bolt keeper 98 comprising receiver 84 with dead bolt opening 90 and latch bolt opening 104. Dead bolt keeper 98, which is in the doorjamb cavity, is comprised of receiver 84, strike 86, strike position sensor 85, position detectors 87, strike actuator 94, and motion translator unit 96. Also shown is dead bolt sensor 88, and strike opening 92, associated with dead bolt sensor 88. Also shown is strike opening 83 and latch lip 89. Strike position sensor 85 and position detectors 87 are similar in their function to the corresponding parts in FIGS. 1, 2, & 3. Actuator 94, motion translator 96 and actuator strike opening 108 are similar in their function to the corresponding parts in FIG. 4. Stepped plate 81 of strike 86 provides for alternative states, sustained by positioning of strike 86.

Figure 8:
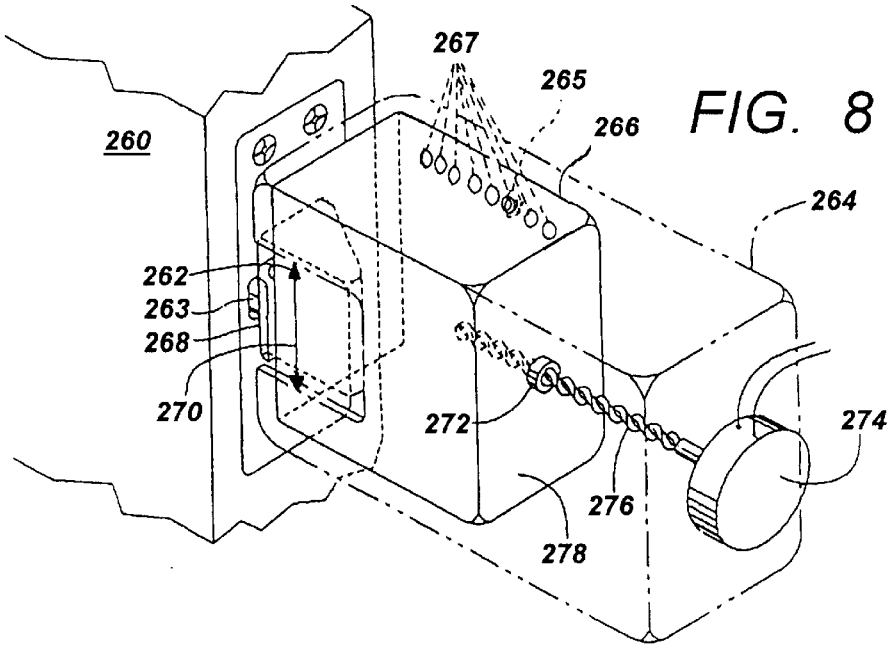
FIG. 8 is a front, top left, perspective view of the latch bolt keeper, with the strike in the pushed-out position, with the door closed.

Strike 86 has three pre-determined positions: 1) Fully pulled-in position as shown in FIG. 6 in which both the dead bolt and the latch bolt can swing out through their respective receiver openings; 2) Fully pushed-out position similar to the position of strikes 16 and 266 in FIG. 1 and FIG. 8 respectively in which neither the dead bolt nor the latch bolt can swing out of receiver 84; and 3) Interim position, in between the pulled-in position and the pushed-out position. In this halfway position, the dead bolt 82 can swing in and out through dead bolt opening 90 and strike opening 83, but latch lip 89 covers some of latch bolt opening 104, thus, enabling the latching mechanism of latch bolt 100. The three positions are set up by the user by means of interacting with the keypad entry and positioning and storing each position in memory.

When dead bolt 82 is extended from door 80, when the door is closed, micro-controller 130 sends a signal and causes strike 86 to move to its pushed-out or locked position. When a signal comes from micro-controller 130 to open the door, strike 86 moves to its pre-set pulled-in position, enabling dead bolt 82 and latch bolt 100 to swing out of receiver 84 through dead bolt opening 90 and latch bolt opening 104.

After the door is opened, strike 86 moves to its pre-set interim position, which allows the latching function of the door's latch bolt 100 with its disabler 101 but still enables dead bolt 82 to swing in through dead bolt opening 90 and strike bolt opening 83. When the door 80 is closed and the dead bolt 82 is extended out of the mortise, the strike 86 moves to its pre-set pushed-out position. When the door is closed but the dead bolt 82 is not extended out of the mortise, strike 86 remains in its pre-set halfway position.

Figure 7:
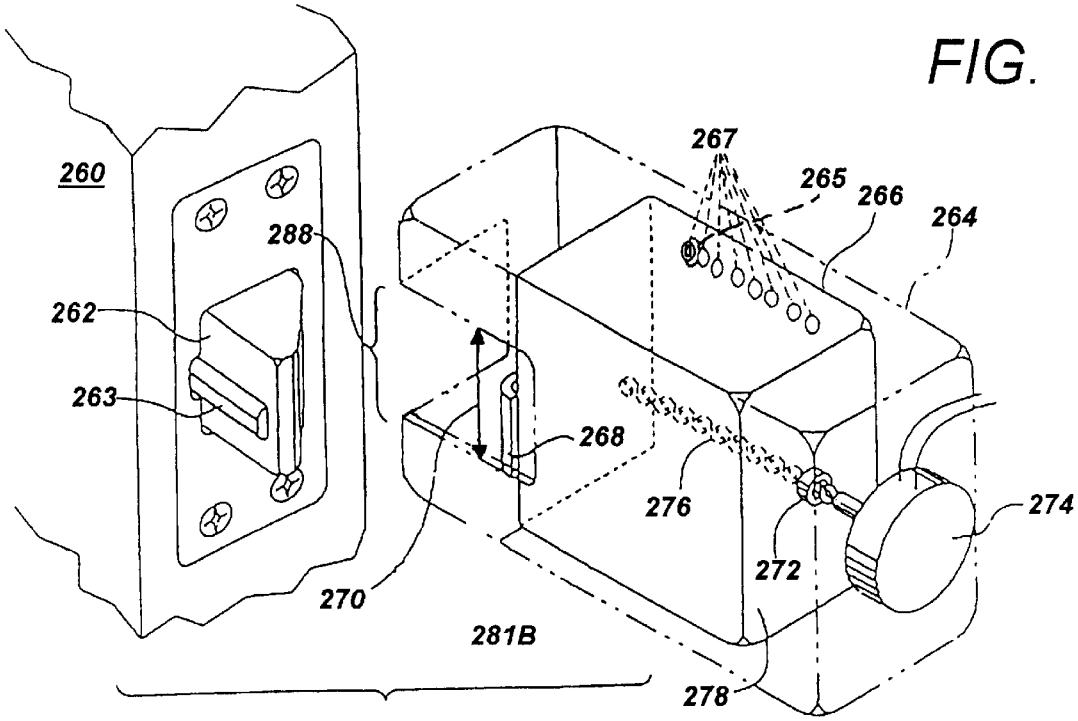
FIG. 7 is a front, top left, perspective view of the latch bolt keeper, with the strike in the pulled-in position, with the door open.

FIG. 7, and FIG. 8 illustrate the latch bolt receiver 264 of the present invention. There is shown a door 260 having latch bolt 262 and a disabler 263. Also illustrated are latch bolt receiver 264, latch bolt strike 266, actuator 274, motion translator 276, and nut 272. Strike 266 has two stable positions in receiver 264: 1) The pushed-out position, which is also the default position, in which latch bolt 262 cannot swing out of the receiver opening 270 but can swing into the receiver 264 by sliding over the lip 268 and latching behind it. 2) The pulled-in position in which latch bolt 262 can swing in and out of receiver 264 through opening 270. Latch bolts usually operate against a spring in the mortise and have only one default position, which is the extended position. When a user attempts to open the door using the electro-mechanical complementary system of this invention, either from the outside by activating code access device 128 (FIG. 11) or from the inside by activating inside door activator 142 (FIG. 11), micro-controller 130 (FIG. 11) sends a signal to latch bolt actuator 274. When latch bolt strike actuator 274 receives a signal from micro-controller 130 to open door 260, strike 266 is pulled in to its pulled-in position by motion translator 276 which allows the passage of latch bolt 262 through receiver opening 270. See discussion on electro-kinetic transducers, actuator and motion translators below. Controlled by micro-controller 130, strike 266 remains in its pulled-in position for a preset time, such as 5 seconds, and then micro-controller 130 reverses the direction of actuator 274 and returns strike 266 to its pushed-out position, allowing the latching function of the door's latch bolt 262. As door 260 is being closed, latch bolt 262 slides over lip 268 into strike 266. When latch bolt 262 passes the edge of lip 268, latch bolt 262 extends into receiver 264 but disabler 263 remains in its pushed-in position into the mortise. See FIG. 9 for a more detailed explanation.

Latch bolt actuator 274 is attached to the back of latch bolt receiver 264. Nut 272 is secured to the back 278 of latch bolt strike 266. By having latch bolt actuator 274 attached securely to receiver 264 and screw 276 passing through nut 272, a turning of screw 276 causes strike 266 to move horizontally within receiver 264 in both directions, corresponding to the direction of the turns of screw 276.

FIGS. 7 & 8 depict a linear actuator, such as series 20000 by HIS of Waterbury, Conn. Alternatively, other actuators could be employed such as a non-captive actuator by the same manufacturer as in FIG. 5.

Figure 9:
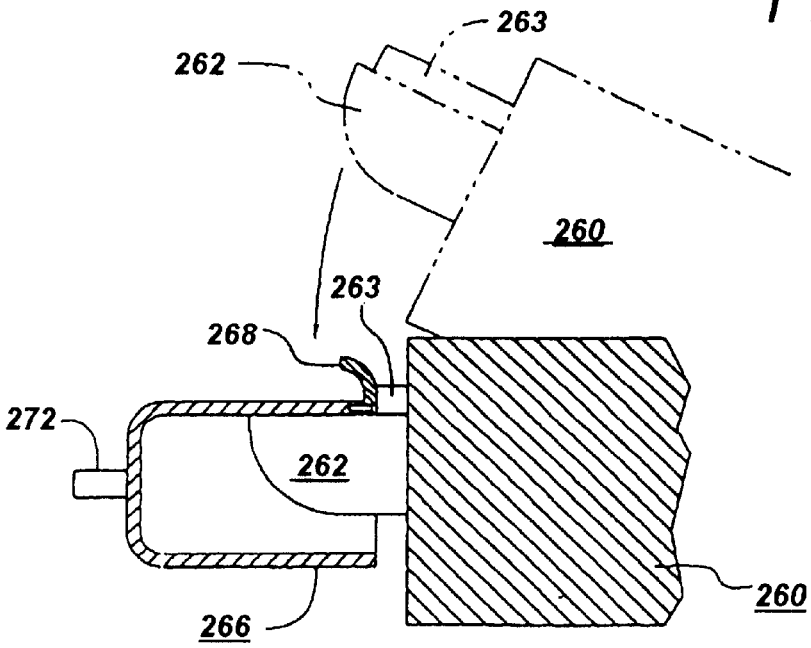
FIG. 9 is a section through the bolt and latch bolt strike, showing the alternate open position.

FIG. 9 illustrates the operation of a dead latch bolt. Here is shown a door 260 with a dead latch bolt 262 and a disabler 263. When door 260 is open (in broken lines), both latch bolt 262 and disabler 263 are extended out of the mortise. When door 260 is closed (in uninterrupted lines), however, latch bolt 262 is extended into the cavity in the doorjamb, in this case the latch bolt strike 266, but the disabler 263 remains pushed into the mortise. Lip 268, which can be adjusted on strike 266 to accommodate different kinds of dead latch bolts (see FIG. 10; 268, 269 A & B, and 289 A & B), holds disabler 263 from being extended into the strike 266. When disabler 263 is pushed into the mortise in the door 260, the latch bolt 262 cannot be pushed into the mortise by applying force on it. This prevents a potential intruder from pushing the latch bolt into the mortise in the door by inserting a credit card between door 260 and the doorjamb.

Figure 10:
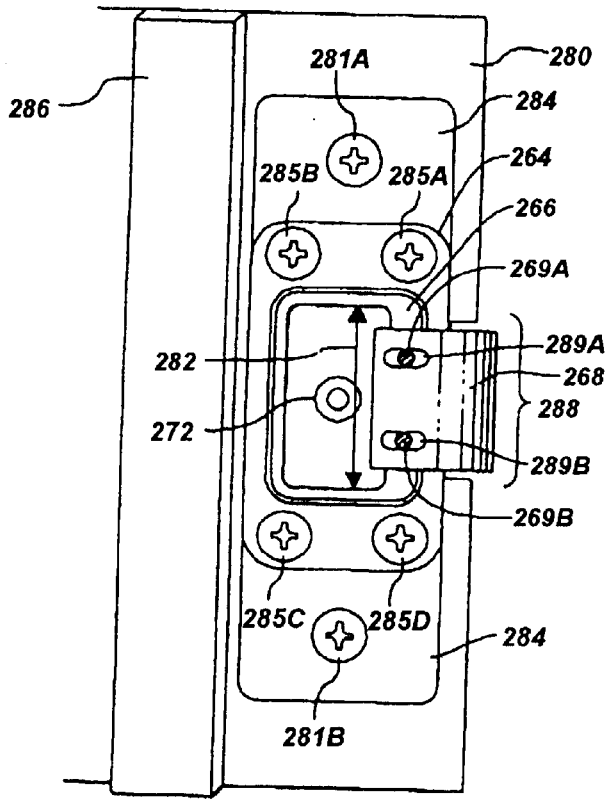
FIG. 10 is a front view of the latch bolt keeper.

FIG. 10 is a front view of the latch bolt apparatus. Here is shown doorjamb 280 with doorstopper 286 and opening 288. Also shown is latch bolt plate 284, connected to doorjamb 280 by two screws 281 (A & B). Behind the latch bolt plate 284 lies latch bolt receiver 264 attached to latch bolt plate 284 by four screws 285 (A, B, C, & D). Also behind latch bolt plate 284 but not connected to latch bolt plate 284 is latch bolt strike 266 with its nut 272 to allow for the motion translator screw (not shown in FIG. 10) which moves back and forth within receiver 264. Latch bolt plate opening 282 enables the latch bolt to go into strike 266 when the door is closed. Lip 268 has two elongated screw holes 269 (A & B), allowing for lip 268 to be adjusted on latch bolt strike 266, accommodating any size of latch bolt. When latch bolt strike 266 is moving within receiver 264, lip 268 moves with strike 266 through opening 288.

The electro-kinetic transducer, which consists of an actuator and a motion translator, moves and positions the linear moving dead bolt strike 16 (FIGS. 1, 2, & 3), strike 36 (FIG. 4), strike 66 (FIG. 5), strike 86 (FIG. 6), and strike 266 for the latch bolt as in FIGS. 7, 8, 9 & 10, enabling the physical locking and unlocking function of the present invention. The motion transducers are controlled by micro-controller 130 through a driver interface such as MOSFET transistor circuitry.

The electro-kinetic transducer subsystems comprise an actuator, such as a motor, a solenoid, or a bender (such as a peizo bender). The actuators may be connected to motion translators, which comprise the mechanical hardware that translate and couple the actuators' output motion to the end of the strikes (16, 36, 66, 86, and 266), which accomplish the work of locking and unlocking. The motion translator may consist of a screw and roll-nut system, available from vendors such as Flennor, of Ridgefield, Conn., a screw and nut system or a screw and bearing system, available from Haydon Switch & Instrument, Inc., of Waterbury, Conn., which translate the rotary motion produced by the motors to linear motion. The motion translator can also consist of worm (see FIG. 4 and FIG. 6), bevel, miter or helical gears, coupled with screws, to transfer rotating motion to linear motion or of a stroke pin for the linear output of a solenoid.

Several combinations of actuators and motion translators can be arranged to provide the required motions from the electro-kinetic transducer to be used in the present invention.

Figure 11:
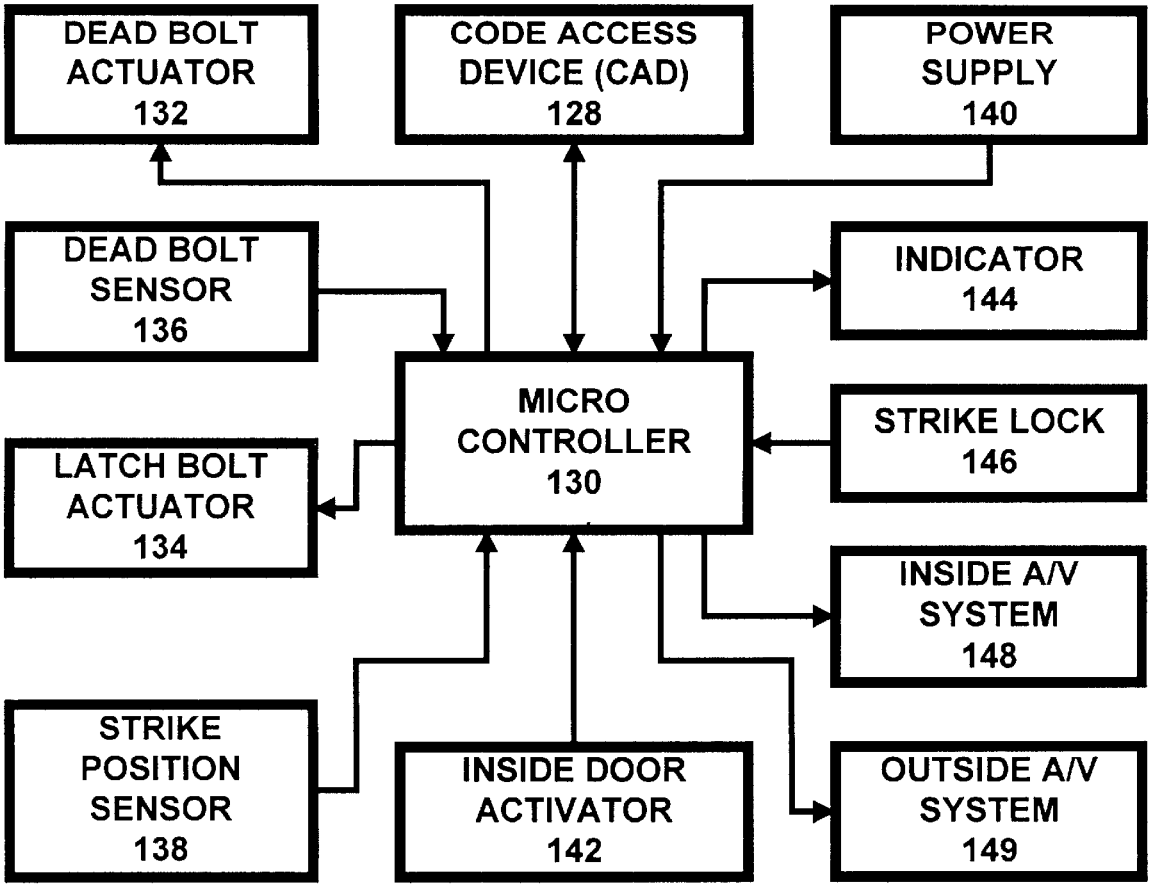
FIG. 11 is a schematic block diagram showing the electrical components of the present invention.

FIG. 11 is a schematic block diagram showing the electrical connections of the present invention in relation to the following components (referring to FIGS. 1, 2 & 3 unless otherwise indicated): dead bolt sensor 18 sensing the state of the door's dead bolt with regard to receiver 14, that is, whether the dead bolt is extended out of the mortise in the door or not extended out of the door when the door is closed (in FIG. 11; dead bolt sensor 136). Actuator 24 causes the movement of strike 16 (in FIG. 11; dead bolt actuator 132). Actuator 274 causes the movement of strike 266 (FIG. 7 & 8) (In FIG. 11; latch bolt actuator 134).

As illustrated in FIG. 11, micro-controller 130 is a single board micro-controller that functions to control, coordinate and to respond to the subsystems comprising the complementary lock system. Micro-controller 130 comprises a central processor, ROM, RAM, and flash RAM circuitry for execution and storage of the programming and user parameter data (such as access codes and dead bolt strike positioning.) Also included in micro-controller 130 is an internal timer clock.

Contained on micro-controller 130 is interface and driver circuitry for interfacing to dead bolt sensor 136 and strike position sensor 138, code access device 128, inside door activator 142, user indicators block 144, inside a/v system 148 and outside a/v system 149, dead bolt actuator 132 and latch bolt actuator 134. Also connected to the micro-controller 130 is strike lock 146 (in FIG. 4; 52). Micro-controller 130 derives its operating power from a power supply 140, which is connected to the AC mains and can also provide a battery backup system. Micro-controller 130 includes application circuitry to allow the recording in memory of the authorized users' access codes to be used in the recognition procedure described in FIGS. 12 and 13, the positioning of the dead bolt strike as described in FIGS. 1, 2, 3, & 6, and the countdown period of the door (FIG. 12, steps 176 & 192 and FIG.13, steps 210 & 224.)

Also illustrated in FIG. 11 is a code access device (CAD) 128 such as keypad or fingerprint reader to control access to the system. There is a power supply 140, and an indicator 144, such as an LED, to indicate whether or not the door is locked. There is an inside door activator 142 to enable the activation of the door's complementary lock system from the inside, and an inside a/v system 148, which also includes a terminal and keypad display, and an outside a/v system 149 to indicate when the door can be opened and to indicate a non-matching code.

Figure 12:
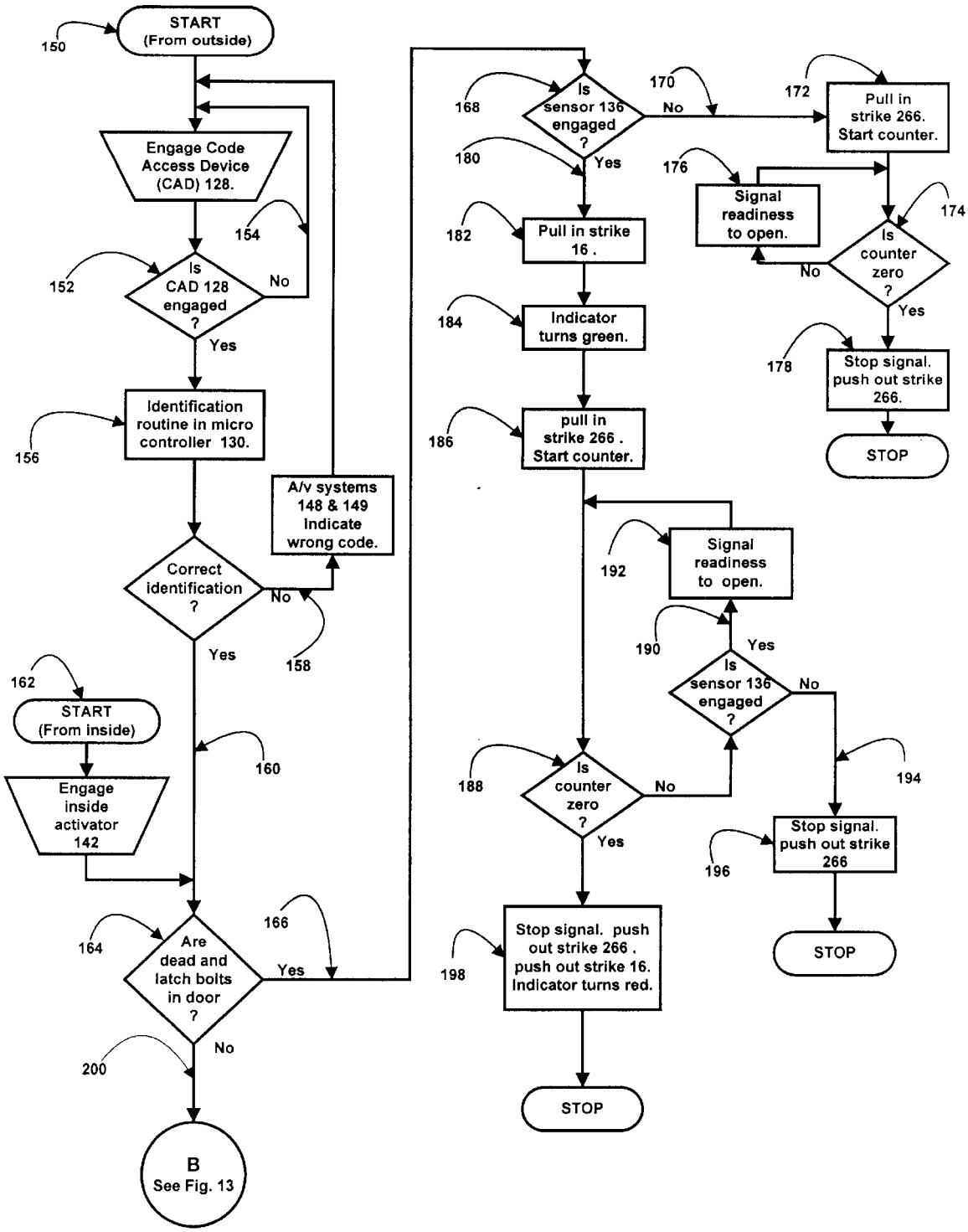
FIG. 12 is a logic diagram showing the sequential steps in the operation of the present invention with both a dead bolt and a latch bolt.
Figure 13:
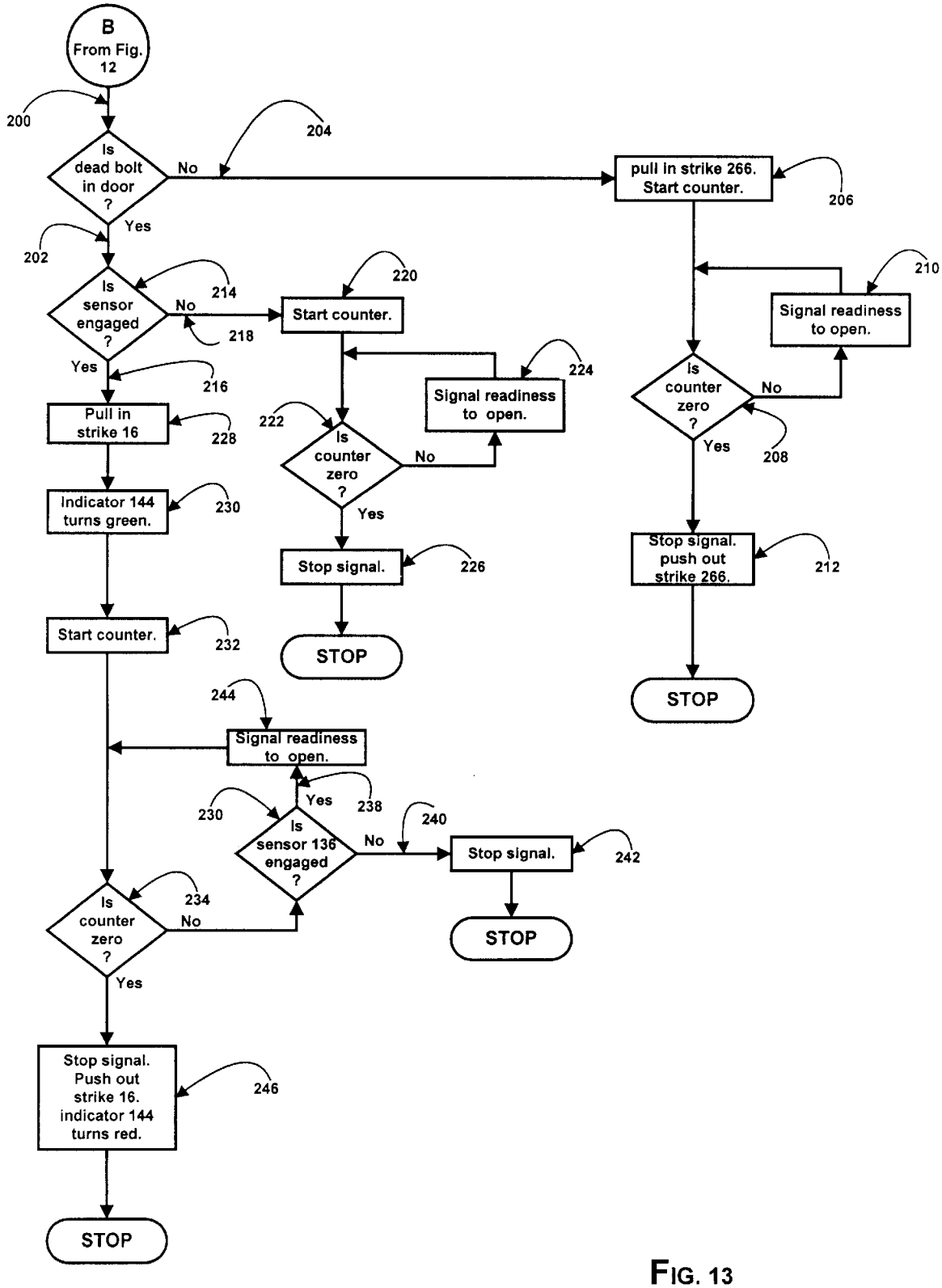
FIG. 13 is a logic diagram showing the sequential steps in the operation of the present invention with either, a dead bolt or a latch bolt.

FIG. 12 is a flowchart showing the sequential steps in the operation of the present invention from the outside, step 150, or the inside, step 162, and assuming that one dead bolt and one latch bolt are present in the door. FIG. 13 is a flowchart showing the sequential steps in the operation of the present invention, assuming either a dead bolt or a latch bolt is present in the door. Both FIGS. 12 & 13 refer to embodiments as described in FIGS. 1, 2, & 3 (for the dead bolt) and FIGS. 7 & 8 (for the latch bolt).

When the door is closed and locked, LED indicator 144 indicates with a red output that the door is closed and locked. When the door is opened or closed but unlocked, LED indicator 144 indicates with a green output that the door is unlocked. Indicator 144 could be an LED or any electronic display such as LCD module. For the purpose of describing the present invention, a red output indicates the door 10 is closed and the dead bolt 12 is extended out of the mortise in the door and strike 16 is in its pushed-out position. A green output indicates that either the door is open, or the door is closed but the dead bolt 12 is not extended out of the door, or the door is closed, the dead bolt 12 is extended out of the door but the strike 16 is in its pulled-in position. As indicated, code access device (CAD) 128 could be any available means, including but not limited to fingerprint reader, keypad, remote control, or voice activator.

Referring to FIG. 12, upon activation of CAD 128, step 152, a recognition procedure is executed in the micro-controller 130, step 156. If the CAD 128 is not activated, the entire operating system is in a low power sleep mode, step 154. If the user access code is not identified, step 158, outside a/v system 149 indicates "wrong code" and the user is allowed to try again. If the user's code is identified, step 160, a quick decision routine, step 164, takes place in micro-controller 130 to ascertain whether the system includes both a dead bolt and a latch bolt. If both bolts are present in the door, step 166, the system verifies if the dead bolt is extended out of the door, step 168. (The user sees indicator 144 light and knows whether the dead bolt is locked or not.) If the door's dead bolt is extended out of the door (the door is locked) as indicated at step 180, micro-controller 130 sends an electrical signal to dead bolt actuator 24, step 182. Dead bolt actuator 24 activates motion translator unit 26, which is attached to strike 16. When strike 16 is cleared of the door's dead bolt, indicator 144 turns from a red light to a green light, step 184, and the door's dead bolt can swing open through receiver opening 20. If the door's dead bolt is not extended out of the door (the door is closed but unlocked), dead bolt strike is in its pulled-in position and the micro-controller skips step 182.

Concurrently, latch bolt actuator 274 (FIGS. 7 & 8) is also energized and pulls in strike 266 (FIGS. 7 & 8) and the countdown timer is started, step 186. When strike 16 is in its pulled-in position and strike 266 is in its pulled-in position, micro-controller 130 starts the inside a/v system 148 and the outside a/v system 149 output, such as a buzzer or light, to indicate that the door is ready to be opened, step 192, which is set by the user in advance for a certain time period, step 190. During the audio/visual signal, the door can be pushed open. When strike 266 is pulled in, the door's latch bolt can swing open through receiver opening 270 (FIGS. 7 & 8) and doorjamb opening 288 (FIG. 10), which allows movement of the door's latch bolt out of latch bolt receiver 264. If the door is not opened during the countdown period, step 188, upon the expiration of the countdown time, strike 266 returns to its default or locked position and strike 16 returns to its pushed-out position and indicator 144 turns back to red output, step 198. If the door has been opened during the countdown period, step 194, strike 266 returns to its default or locked position and the ready-to-open signal stops, step 196.

If the door's dead bolt is not extended out of the door (the door is closed but unlocked) step 170, the dead bolt strike is in its pulled-in position, sensor 18 (in FIG. 11; 136) is not activated and indicator 144 remains in the green output state. Micro-controller 130 sends an electrical signal to latch bolt actuator 274 (FIGS. 7 & 8) to pull in strike 266 and starts the countdown timer, step 172. When strike 266 is in its pulled-in position, micro-controller 130 starts the inside a/v system 148 and the outside a/v system 149 output, step 176, which is set in advance for a certain time period, step 174. Upon the expiration of the countdown time, the ready-to-open signal stops and strike 266 returns to its default, pushed-out position, step 178.

When the door is being closed (not shown in the flowchart), if the door's dead bolt 12 is extended out of the mortise, it passes through opening 20 in receiver 14, and re-engages sensor 18. When sensor 18 is re-activated, micro-controller 130 sends a signal to dead bolt actuator 24 to push out strike 16. The door is now closed and locked and indicator 144 turns from a green output to a red output. As latch bolt strike 266 (FIGS. 7 & 8) has already returned to its pushed-out position (steps 196 or 198), the latch bolt 262 (FIGS. 7 & 8) slides over lip 168 (FIGS. 7 & 8) when the door is being closed, performing the door's normal latching function.

When the door is being closed while the door's dead bolt 12 is not extended out, dead bolt actuator 24 is not energized and indicator 144 remains in a green output light, which indicates that the door is closed but unlocked and dead bolt strike 16 remains in its pulled-in position. Upon locking the dead bolt using the mechanical door system, the sensor 18 changes voltage level thereby signaling the micro-controller 130 and the dead bolt strike 16 is pushed out to its pushed-out position. The door is now closed and locked and the indicator 144 turns from a green output to a red output.

If the user wishes to open the door from the inside using the complementary lock system, step 162, the user activates the inside door activator 142. Upon employment of the inside door activator 142, a similar routine as above, without the identification sub-routine, takes place.

The internal countdown clock could be set up for different length of times for operating the system from outside, using CAD 128, or the inside, using inside door activator 142.

Referring to FIG. 13, illustrated is a flowchart showing doors where only a latch bolt or a dead bolt, but not both, is present in the door, step 200 in FIG. 12 and FIG. 13. In doors where only the latch bolt is present and only the latch bolt receiver is installed, step 204 of FIG. 13, either the CAD 128 or the inside door activator 142 would send a signal to micro-controller 130 which would activate latch bolt actuator 274 (FIGS. 7 & 8) and the internal countdown clock, step 206. When strike 266 is in its pulled-in position, micro-controller 130 starts the inside a/v system 148 and the outside a/v system 149 output, step 210, which is set in advance for a certain time period, step 208. Upon the expiration of the countdown time, the ready-to-open signal stops and the strike 266 returns to its default pushed-out position, step 212. When the door is being closed, as latch bolt strike 266 (FIGS. 7 & 8) has already returned to its pushed-out position (steps 212), the latch bolt 262 (FIGS. 7 & 8) slides over the lip 168 (FIGS. 7 & 8), performing the door's normal latching function.

In doors where only a dead bolt is present and only a dead bolt receiver is installed, step 202, upon activating CAD 128 and the completion of the identification sub-routine, or the activation of inside door activator 142, a signal is sent to the micro-controller 130. The system verifies whether the dead bolt is extended out of the door, step 214. The user sees indicator 144 light and knows whether the door is locked or not. If the door's dead bolt is extended out of the door (the door is locked) as indicated at step 216, micro-controller 130 sends an electrical signal to dead bolt actuator 24, step 228. Dead bolt actuator 24 activates motion translator unit 26, which is attached to strike 16. When strike 16 is cleared of the door's dead bolt, indicator 144 turns from a red light to a green light, step 230, and starts the countdown timer, step 232. When strike 16 is pulled-in, micro-controller 130 starts the inside a/v system 148 and the outside a/v system 149 output, such as a buzzer or light, to indicate that the door is ready to be opened, step 244, which is set in advance for a certain time period, step 230. During the audio/visual signal, the door can be swung open. If the door is not opened during the countdown period, step 238, upon the expiration of the countdown period, the strike 16 returns to its pushed-out position, the ready-to-open signal stops, and the indicator 144 turns back to red output, step 246. If the door is opened during the countdown period, step 240, the ready-to-open signal stops, step 242 and strike 16 remains in its pulled-in position.

If the door's dead bolt is not extended out of the door while the door is closed (the door is closed but unlocked) step 218, sensor 18 is not activated and indicator 144 remains in the green state. At this point the dead bolt strike 16 is in its pulled-in position. Micro-controller 130 starts the countdown timer, step 220, and starts inside a/v system 148 and the outside a/v system 149 outputs, step 224, which is set in advance for a certain time period, step 222. Upon the expiration of the countdown time, the ready-to-open signal stops, step 226. While the countdown period and the output of the inside a/v system 148 and the outside a/v system 149 are not necessary for the user to be able to open the door, it serves as a reminder to the user that the door is unlocked.

Having thus described the invention,

We claim:

1. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move each strike in a horizontal motion, electronic means comprising a controller, and means to activate the door locking system by moving each said strike between its first and second position, wherein the means to move each said strike within its receiver is an electromechanical actuator, which moves each said strike between its first and second positions in both directions, the system further comprising dynamic braking means inhibiting the motion of each strike when a force other than the force from the actuator is acting upon each strike.

2. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, said system further comprising a lip, affixed to each said strike, adapted to guide a latch bolt to slide over each strike into the receiver and means to adjust the position of the lip on each strike.

3. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, the system further comprising sensor means adapted to sense the presence of a dead bolt in the receiver.

4. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, the system further comprising electronic means adapted to determine which of the receivers and strikes are associated with dead bolts and which of the receivers and strikes are associated with latch bolts.

5. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, the system further comprising calibration control means adapted to enable a user to set the position of the strike within its receiver for the first position and the position of the strike within its receiver for the second position and store that information in the memory of said controller for remembering said first position and said second position.

6. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, wherein the means to move each said strike within its receiver is an electromechanical actuator, which moves each said strike between its first and second positions in both directions, the system further comprising fault tolerance control means adapted to always return the strike to its preset first or second positions if forces other than that of the actuator shift the position of the strike within the receiver.

7. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, the system further comprising sensor means to sense the presence of each dead bolt in a receiver, means to automatically move each said strike associated with a respective dead bolt from its second position to its first position when said sensor means senses the presence of a dead bolt in its respective receiver.

8. A door locking system for a door having one or more bolts, comprising an opening opposite to each of the bolts in the door, each said opening having a receiver, an opening in each receiver adapted to receive a respective bolt, a strike moving horizontally within each said receiver between a first position in which a bolt cannot swing out of said receiver through said receiver opening and a second position in which a bolt can swing out of said receiver through said receiver opening, means to move the strike in a horizontal motion, electronic means comprising a controller, and means to activate the door locking system by moving each said strike between its first and second position, the system further comprising sensor means to sense the presence of each dead bolt in a receiver, means to automatically move each said strike associated with a respective dead bolt from its first position to its second position when said sensor means does not sense the presence of a dead bolt in its respective receiver.

9. A door locking apparatus for a door having one dead bolt and one latch bolt, comprising a receiver, openings in the receiver adapted to receive both bolts, a strike, having a stepped plate, moving horizontally within said receiver between a first position in which both said bolts cannot swing out of said receiver through their corresponding receiver openings, a second position, in which both said bolts can swing out of said receiver through their corresponding receiver openings, and a third position in which said dead bolt can swing out of said receiver through its corresponding receiver opening but said latch bolt cannot swing out of said receiver through its corresponding receiver opening.

10. A door locking system for a door having one dead bolt and one latch bolt, comprising an opening opposite to the bolts, said opening having a receiver, openings in said receiver adapted to receive each said bolt, a strike having a stepped plate moving horizontally within said receiver between a first position in which both said bolts cannot swing out of said receiver through their corresponding receiver openings, a second position, in which both said bolts can swing out of said receiver through their corresponding receiver openings, and a third position in which said dead bolt can swing out of said receiver through its corresponding receiver opening but said latch bolt cannot swing out of said receiver through its corresponding receiver opening, means to move said strike in a horizontal motion, electronic means comprising a controller, and means to activate the door locking system by moving each said strike between its first, second and third positions.

11. The system of claim 10 in which the means to move said strike within said receiver is an electromechanical actuator, which moves the strike between its first, second and third positions, in all directions.

12. The system of claim 10, further comprising motion translator means between the actuator and the strike to convert the motion of said actuator to the linear motion of said strike.

13. The apparatus of claim 12 which the motion translator means comprise a screw, a gearing system, or a screw and a gearing system.

14. The system of claim 10 further comprising dynamic braking means inhibiting the motion of the strike when a force other than the force from the actuator is acting upon the strike.

15. The system of claim 10 further comprising electromechanical means having two positions, a first position allowing motion of the strike within said receiver and a second position preventing motion of the strike within said receiver.

16. The system of claim 10 further comprising a lip, affixed to the strike, adapted to guide a latch bolt to slide over the strike into the receiver when the strike is in its said first or third positions.

17. The apparatus of claim 16 further comprising means to adjust the position of the lip on the strike.

18. The system of claim 10 further comprising sensor means adapted to sense the presence of the dead bolt in the receiver.

19. The system of claim 10 further comprising means to detect the exact position of said strike within said receiver.

20. The system of claim 10 further comprising means to actuate a time delay between the second position of the strike and automatically moving the strike to its third position.

21. The system of claim 10 further comprising closed loop feed back control means adapted to verify which of the strike's end motions is the first position and which of the strike's end motions is the second position.

22. The system of claim 10 further comprising calibration control means adapted to enable a user to set up the position of the strike within the receiver for its first position, the position of the strike within the receiver for its second position, and the position of the strike within the receiver for its third position and store all of the position information in the memory of said controller.

23. The system of claim 10 further comprising fault tolerance control means adapted to always return the strike to its preset first, second or third positions if forces other than that of the actuator shift the position of the strike within the receiver.

24. The system of claim 10 further comprising sensor means to sense the presence of said dead bolt in said receiver, means to automatically move said strike from its third position to its first position when said sensor means senses the presence of said dead bolt in said receiver.

25. The system of claim 10 further comprising sensor means to sense the presence of said dead bolt in said receiver, means to automatically move said strike from its first position to its third position when said sensor means does not sense the presence of said dead bolt in said receiver.

* * * * *